US010321766B2

(12) United States Patent
Woolnough

(10) Patent No.: US 10,321,766 B2
(45) Date of Patent: Jun. 18, 2019

(54) LOUNGE CUSHION

(71) Applicant: Carla Woolnough, Guelph (CA)

(72) Inventor: Carla Woolnough, Guelph (CA)

(73) Assignee: Carla Woolnough, Guelph, Ontario (CA)

( * ) Notice: Subject to any disclaimer, the term of this patent is extended or adjusted under 35 U.S.C. 154(b) by 0 days.

(21) Appl. No.: 15/712,213

(22) Filed: Sep. 22, 2017

(65) Prior Publication Data

US 2018/0084916 A1 Mar. 29, 2018

Related U.S. Application Data

(60) Provisional application No. 62/398,909, filed on Sep. 23, 2016.

(51) Int. Cl.

| | |
|---|---|
| ***A47C 7/38*** | (2006.01) |
| ***A47C 7/02*** | (2006.01) |
| ***A47C 20/02*** | (2006.01) |
| ***A47C 31/11*** | (2006.01) |
| ***A47C 1/14*** | (2006.01) |

(52) U.S. Cl.

CPC ..... *A47C 7/383* (2013.01); *A47C 1/143* (2013.01); *A47C 7/021* (2013.01); *A47C 20/026* (2013.01); *A47C 31/11* (2013.01)

(58) Field of Classification Search

CPC ..... A47C 7/383; A47C 7/021; A47C 7/386; A47C 7/0213; A47C 1/143; A47C 1/14; A47C 20/026; A47C 31/11

USPC ..... 297/220; 5/110, 111

See application file for complete search history.

(56) References Cited

U.S. PATENT DOCUMENTS

| | | | | | |
|---|---|---|---|---|---|
| 3,897,102 | A * | 7/1975 | Lemaire | A47C 1/143 | 297/283.3 |
| 4,891,854 | A | 1/1990 | Finkelstein | | |
| 5,222,779 | A * | 6/1993 | Johnson | A47C 1/143 | 297/283.3 |
| D352,635 | S * | 11/1994 | Yoder | 297/900 | |
| 5,426,798 | A * | 6/1995 | Guarino | A47C 20/026 | 5/638 |
| 5,546,619 | A | 8/1996 | Braun | | |
| 5,624,157 | A * | 4/1997 | Kostuk | A47C 1/143 | 297/218.1 |
| 5,926,871 | A | 7/1999 | Howard | | |
| 5,946,749 | A * | 9/1999 | Sewell | A47C 1/143 | 297/188.08 |
| 5,970,546 | A | 10/1999 | Danis | | |
| 6,042,184 | A | 3/2000 | Kofoed | | |
| 6,412,127 | B1 | 7/2002 | Cuddy | | |
| 6,588,034 | B2 * | 7/2003 | Nation | A47C 1/143 | 5/110 |

(Continued)

*Primary Examiner* — Mark R Wendell

(74) *Attorney, Agent, or Firm* — Rowand LLP

(57) ABSTRACT

A reversible lounge cushion is disclosed. The lounge cushion includes: an elongate cushion body having an upper cushion portion and a lower cushion portion foldably connected to the upper cushion portion, the upper cushion portion having a top surface and a bottom surface opposed to the top surface, the cushion body defining a cavity adjacent to a top end of the cushion body, wherein the cavity extends between a first aperture on the top surface and a second aperture on the bottom surface, and a permeable screen disposed in the cavity between the first aperture and the second aperture.

16 Claims, 5 Drawing Sheets

(56) References Cited

U.S. PATENT DOCUMENTS

| | | | | |
|---|---|---|---|---|
| 6,860,567 | B1 * | 3/2005 | Bauer | A47C 1/143 297/144 |
| 6,938,287 | B1 * | 9/2005 | Mahshie | A47C 17/66 297/900 |
| 7,194,778 | B2 | 3/2007 | Riach | |
| 7,543,345 | B2 | 6/2009 | Wilson et al. | |
| 7,676,867 | B2 | 3/2010 | De Laura | |
| 7,959,222 | B1 * | 6/2011 | Powell | A47C 20/026 297/188.06 |
| D657,169 | S * | 4/2012 | Pratt | D6/716.5 |
| 8,636,318 | B2 | 1/2014 | Newsome | |
| 8,708,406 | B1 * | 4/2014 | Powell | A47C 21/00 297/188.06 |
| 2005/0177946 | A1 | 8/2005 | Riley | |
| 2005/0262641 | A1 | 12/2005 | Maslyar | |
| 2006/0005313 | A1 * | 1/2006 | Fluellen | A47C 17/66 5/638 |
| 2006/0230536 | A1 | 10/2006 | Friedman et al. | |
| 2010/0325802 | A1 | 12/2010 | Schwartz et al. | |

* cited by examiner

LOUNGE CUSHION

TECHNICAL FIELD

The present disclosure relates to accessories for furniture and, in particular, to cushions for use with lounge and patio chairs.

BACKGROUND

Lounge chairs are popular for use outdoors, for example, in yards, patios, beaches, or pool areas. Lounge chairs are often designed to accommodate various resting positions. For example, lounge chairs may be adjusted to support a user in a prone position, a reclined position, or an upright sitting position. Lounge cushions can be used to provide comfort during use of a lounge chair.

BRIEF DESCRIPTION OF DRAWINGS

Reference will now be made, by way of example, to the accompanying drawings which show example embodiments of the present application and in which.

Like reference numerals are used in the drawings to denote like elements and features.

DETAILED DESCRIPTION OF EXAMPLE EMBODIMENTS

In one aspect, the present disclosure describes a reversible lounge cushion. The reversible lounge cushion includes: an elongate cushion body having an upper cushion portion and a lower cushion portion foldably connected to the upper cushion portion, the upper cushion portion having a top surface and a bottom surface opposed to the top surface, the cushion body defining a cavity adjacent to a top end of the cushion body, wherein the cavity extends between a first aperture on the top surface and a second aperture on the bottom surface; and a permeable screen disposed in the cavity between the first aperture and the second aperture.

In another aspect, the present disclosure describes a lounge chair assembly. The lounge chair assembly includes a lounge chair frame and a reversible lounge cushion which is removably mounted on the lounge chair frame. The lounge cushion includes: an elongate cushion body having an upper cushion portion and a lower cushion portion foldably connected to the upper cushion portion, the upper cushion portion having a top surface and a bottom surface opposed to the top surface, the cushion body defining a cavity adjacent to a top end of the cushion body, wherein the cavity extends between a first aperture on the top surface and a second aperture on the bottom surface, and a permeable screen disposed in the cavity between the first aperture and the second aperture.

Other example embodiments of the present disclosure will be apparent to those of ordinary skill in the art from a review of the following detailed descriptions in conjunction with the drawings.

Figure 1A:
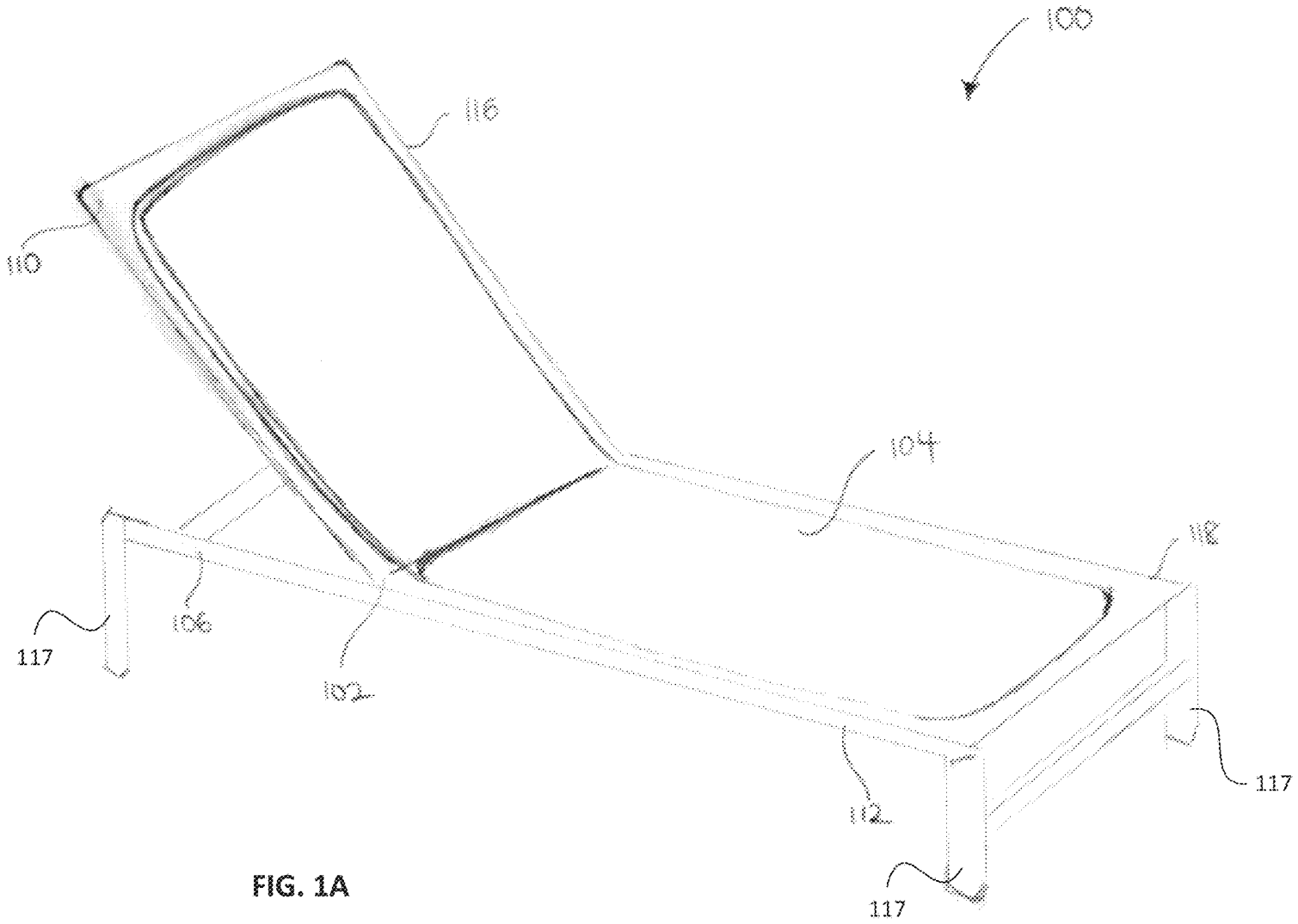
FIG. 1A shows an example lounge chair assembly in accordance with example embodiments of the present disclosure.

Reference is first made to FIG. 1A, which shows an example lounge chair assembly 100 in accordance with example embodiments of the present disclosure. The lounge chair assembly 100 includes a lounge chair 102 and a lounge cushion 104. The lounge chair 102 includes a frame 106 which provides structural support for the lounge chair 102 and which defines the general shape of the lounge chair 102. The lounge chair 102 may include one or more contiguous sections which support different portions of a user's body when a user sits or lies on the lounge chair 102. For example, the lounge chair 102 may include a first section 116 for supporting a user's upper body and a second section 118 (which may or may not be directly connected to the first section) for supporting, at least, the user's lower body. The frame 106 of the lounge chair 102 may be constructed from various different materials including, among others, wood, plastic, metal alloys, or a combination thereof.

The lounge chair 102 is configured to support a user's body in one or more different positions. For example, the lounge chair 102 may support a user in a prone (i.e. face-down) position, a reclined position, or an upright sitting position. More specifically, the frame 106 of the lounge chair 102 may be adjustable between numerous different configurations to support a user in a supine, prone, or sitting position. In at least some embodiments, the frame 106 includes upper support frame 110 and lower support frame 112 which support a user's upper body and lower body, respectively, when the user rests on the lounge chair 102. For example, the upper support frame 110 may support a user's head and at least a part of the user's back when the user is sitting or reclined in the lounge chair 102, while the lower support frame 112 supports, at least, the user's legs. The upper support frame 110 may be foldable/pivotable with respect to the lower support frame 112 such that the lounge chair 102 can be switched between different configurations. For example, the frame 106 may be adjusted to switch the lounge chair 102 between a horizontal position (in which the upper support frame 110 is generally parallel to and coplanar with the lower support frame 112), a reclined position (in which the upper support frame 110 is maintained at a fixed angle with respect to the lower support frame 112), and an upright position (in which the upper support frame 110 is generally perpendicular to the lower support frame 112). The frame 106 may thus support a supine or prone position of a user, a fully upright position, as well as a range of possible intermediate reclined positions. In the example of FIG. 1A, the upper support frame 110 and the lower support frame 112 are supported above ground by a plurality of legs 117.

The lounge cushion 104 is removably mounted on the lounge chair frame 106. In some embodiments, the lounge cushion 104 may be secured to the lounge chair frame 106 using one or more fastening mechanisms, such as Velcro, ties, or toggle fasteners. For example, the lounge cushion 104 may include one or more fasteners that can be tied to parts of the lounge chair frame 106 for maintaining the lounge cushion 104 fixed in position with respect to the lounge chair frame 106. The lounge cushion 104 is shaped to generally conform to the shape of the body supporting surfaces of the lounge chair 102. The lounge cushion 104 may, for example, be shaped to include portions corresponding to the upper and lower support frames 110 and 112, respectively. As shown in the example of FIG. 1, the lounge cushion 104 may be sized to substantially cover the body supporting surfaces of the lounge chair 102. In particular, when the lounge cushion 104 is mounted on top of the lounge chair frame 106, the lounge cushion 104 may cover substantially the entire length of the lounge chair 102.

Figure 1B:
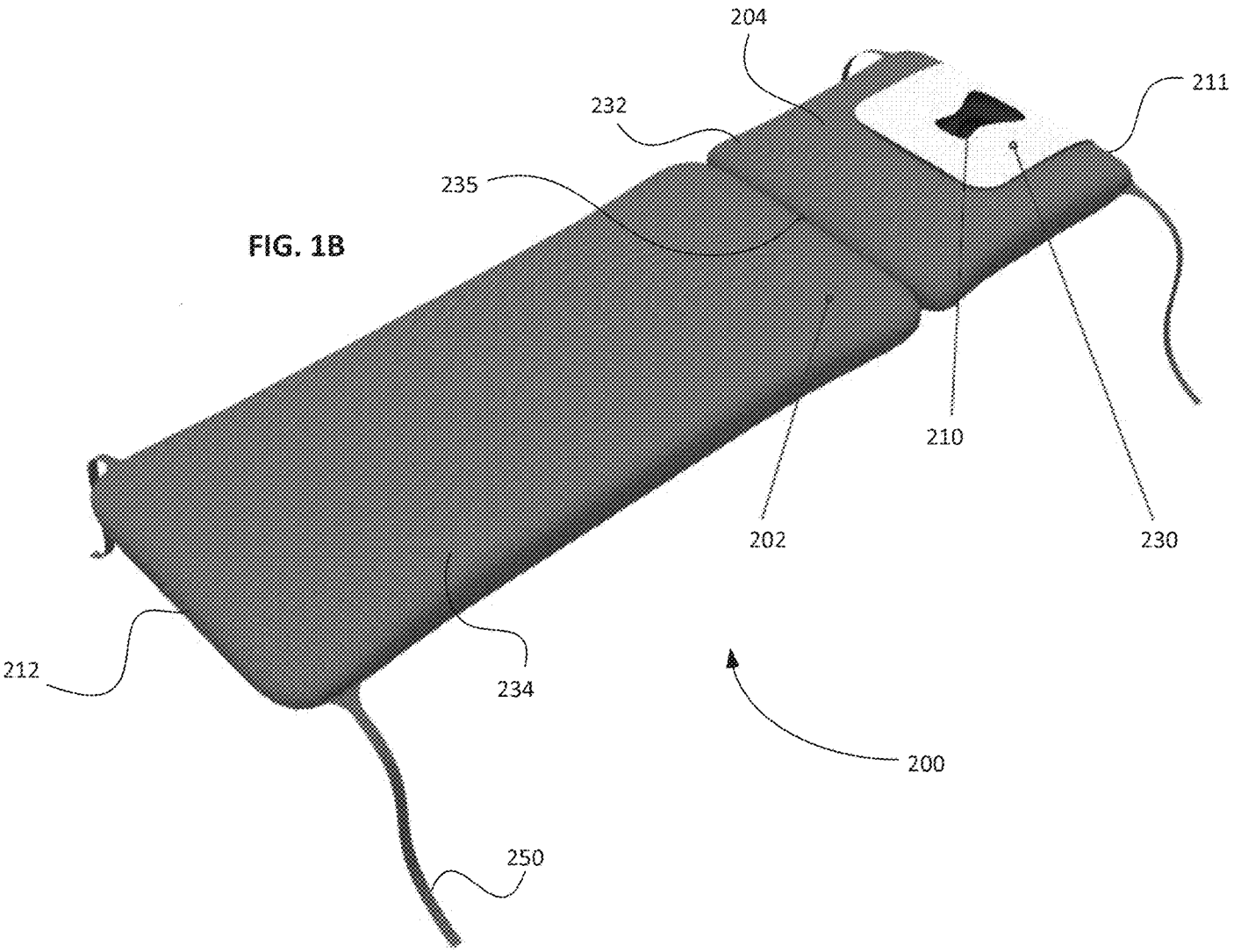
FIG. 1B shows a perspective view of an example lounge cushion in accordance with example embodiments of the present disclosure.
Figure 2:
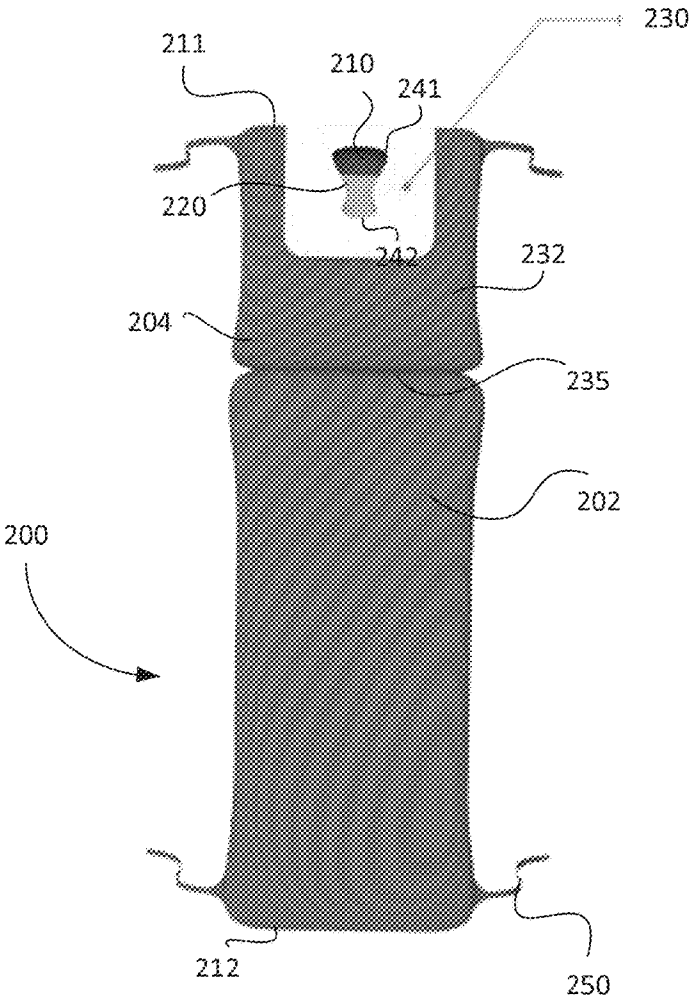
FIG. 2 shows a top view of an example lounge cushion in accordance with example embodiments of the present disclosure.

Reference is now made to FIG. 1B, which shows a perspective view of an example lounge cushion 200, and FIG. 2, which shows a top view of the lounge cushion 200. The lounge cushion 200 is suitable for use with a lounge chair, such as lounge chair 102 of FIG. 1. The lounge cushion 200 includes an elongate cushion body 202. In at least some embodiments, the cushion body 202 comprises an elongate pad having one or more of its surfaces covered by a fabric cover. The elongate pad may, for example, include a single cushion or two separate cushions. The fabric cover may be removable (i.e. detachable) from the pad or it may be integral with the pad. The pad may be constructed of an elastic compressible material, such as polyurethane foam (including foam rubber), gel foam, memory foam, or other types of open-cell foams. The fabric cover may be suitable for use in outdoor environments. For example, the fabric cover may be made from fabric that has undergone a chemical treatment process. The fabric cover may be made from, among others, solution-dyed acrylics, acrylic-coated polyesters, vinyl-coated synthetic fiber mesh, olefin, or canvas.

The cushion body 202 includes an upper cushion portion 232 and a lower cushion portion 234. For example, the upper cushion portion 232 and the lower cushion portion 234 may comprise two separate cushions of a pad of the cushion body 202. When a user sits on the lounge cushion 200 that is mounted on a lounge chair, the upper cushion portion 232 may be configured to support the user's upper body (i.e. head, back) while the lower cushion portion 234 may be configured to support the user's legs. In particular, the upper cushion portion 232 and lower cushion portion 234 may generally correspond in position to an upper support section and a lower support section of a lounge chair, such as the upper support frame 110 and lower support frame 112 of FIG. 1, when the cushion body 202 is mounted on the lounge chair.

The upper cushion portion 232 is foldably connected to the lower cushion portion 234. That is, the upper cushion portion 232 may fold (pivot) about a connection between the upper cushion portion 232 and the lower cushion portion 234. As shown in FIG. 1B, the upper cushion portion 232 and the lower cushion portion 234 are connected at a line 235, and at least one of the cushion portions is foldable along line 235 with respect to the other of the cushion portions. Such a foldable connection between the upper cushion portion 232 and the lower cushion portion 234 may, for example, allow the cushion body 202 to conform to the possible different support positions of a lounge chair on which the lounge cushion 200 is mounted. For example, the cushion body 202 may be switched between a horizontal position (in which the upper cushion portion 232 and the lower cushion portion 234 are arranged to lie generally side-by-side in the same plane), a reclined position (in which the upper cushion portion 232 is maintained at a fixed angle with respect to the lower cushion portion 234), and an upright position (in which the upper cushion portion 232 is arranged to be substantially perpendicular to the lower cushion portion 234), by folding one of the upper cushion portion 232 and the lower upper cushion 235 relative to the other. The upper cushion portion 232 may be freely foldable with respect to the lower cushion portion 234 such that the cushion portions can accommodate various different positions (e.g. horizontal, fully upright, intermediate reclined) of the corresponding lounge chair. The upper cushion portion 232 and the lower cushion portion 234 can thus be supported by the support frames of a lounge chair such that the cushion portions are positioned at an angle (of inclination) with respect to each other.

In at least some embodiments, the connection between the upper cushion portion 232 and the lower cushion portion 234 may be provided by a fabric cover which covers a pad of the cushion body 202. In particular, the upper cushion portion 232 and the lower cushion portion 234 may be separate cushions that are foldably connected (at line 235) via a fabric cover. For example, a single fabric cover may include two pockets, separated at line 235, that are sized to receive an upper cushion and a lower cushion in such a way that, when the cushions are inserted into and secured to the pockets, the upper cushion and the lower cushion are movable in a folding manner relative to each other.

The upper cushion portion 232 has a top surface 204 and a bottom surface 206 opposite to the top surface 204. The top surface 204 and the bottom surface 206 are both adapted to support parts of a person's body (for example, in both prone and sitting positions). In particular, the lounge cushion 200 may be mounted on a lounge chair such that either the top surface 204 is positioned to contact and support a user's upper body (i.e. the bottom surface 206 is faced towards the support surface of the lounge chair) or the bottom surface 206 is positioned to contact and support the user's upper body (i.e. the top surface 204 is faced towards the support surface of the lounge chair). In some embodiments, the distance between the top surface 204 and the bottom surface 206 may exceed 3 inches. In other words, the upper cushion portion 232 may have a thickness of at least 3 inches. For example, the upper cushion portion 232 may have a thickness of between 3.4 and 4.5 inches. In at least some embodiments, the cushion body 202 itself may have a thickness of at least 3 inches. For example, the cushion body 202 may have a thickness of between 3.4 and 4.5 inches.

As shown in FIG. 2, the cushion body 202 defines a cavity 210. The cavity 210 is positioned adjacent to a top end 211 of the cushion body 202. The top end 211 is the end of the upper cushion portion 232 that is proximal to a user's head when the user rests on the cushion body 202. Specifically, the top end 211 is the end of the upper cushion portion 232 that is distal to or furthest from the connection region (i.e. line 235) with the lower cushion portion 234. In at least some embodiments, the cavity 210 is disposed in spaced relation to the top end 211. The cavity 210 is designed to receive at least a portion of a user's face when the user rests in a prone position on the cushion body 202. In particular, the cushion body 202 provides a cavity for receiving part of a user's face when the user is lying in a prone position in the lounge chair, thereby obviating the need for the user to turn her neck to the side when lying on the cushion body 202 in the prone position.

The cavity 210 extends between a first aperture 220 on the top surface 204 and a second aperture 222 (shown in FIG. 3) on the bottom surface 206. In particular, the cavity 210 is an opening defined in the upper cushion portion 232 which extends completely through the cushion body 202 between the top surface 204 and the bottom surface 206.

In at least some embodiments, the cavity 210 is substantially centrally disposed between opposed lateral edges of the cushion body 202. That is, the cavity 210 may be equidistant from the left and right side edges of the cushion body 202, where the side edges are those edges of the cushion body 202 that are generally perpendicular to the top end 211 and that extend between the top end 211 and a bottom end 212 opposed to the top end 211. In the example shown in FIG. 2, the cavity 210 is in the form of a channel which extends along a central axis of the cushion body 202, where the central axis is an axis extending longitudinally between the top end 211 and the bottom end 212. More specifically, the first aperture 220 defines a first end 241 and a second end 242 opposite to the first end 241, where the first end 241 is the end of the first aperture 220 that is closer to the top end 211 of the cushion body 202. In at least some embodiments, the first end 241 of the first aperture 220 has a greater width than the second end 242. In particular, the width of the first aperture 220 may generally decrease from the first end 241 to the second end 242. This shape of the first aperture 220 may facilitate comfortable placement of parts of a user's face into the cavity 210 when the user lies in a prone position on the cushion body 202. The wider portion of the first aperture 220 (i.e. portion that is closer to the first end 241) may be suitable for receiving the upper portion of a user's face, such as the forehead and eyes, while the lower portion of the user's face (e.g. mouth, chin) can be inserted through the narrower portion of the first aperture 220, closer to the second end 242. The lateral edges of the first aperture 220, which extend between the first end 241 and the second end 242, can then support and release pressure from the user's cheekbones. In some embodiments, the width of the first end 241 is greater than 4 inches. For example, the width of the first end 241 may be between 4.5 and 6 inches. In some embodiments, the width of the second end 242 is less than 4 inches. For example, the width of the second end 242 may be between 2.5 and 3.5 inches. The length of the first aperture 220, or the perpendicular distance between the first end 241 and the second end 242, may be greater than 6 inches. For example, the length of the first aperture 220 (and, accordingly, the length of the cavity 210) may be between 6 and 7 inches.

The lounge cushion 200 may include a face cloth 230. The face cloth 230 may be removably attached to the upper cushion portion 232 to provide a smooth surface that contacts parts of a user's face when the user lies in a prone position. As shown in FIG. 1B, the face cloth 230 may include a cutout that corresponds in size and shape to the first aperture 220. The face cloth 230 can then be attached to the upper cushion portion 232 and positioned to align the cutout with the first aperture 220, allowing a user to rest parts of their face (e.g. cheekbones) on the face cloth 230 and place other parts of their face (e.g. nose, mouth) in the cavity 210 when lying in the prone position. The face cloth 230 may be attached to the upper cushion portion 232 by using, for example, metal clips, Velcro attachment, or an adhesive.

As in the example of FIG. 1B, the lounge cushion 200 may include fasteners 250. The fasteners 250 can be used to secure the lounge cushion 200 to a lounge chair. In FIG. 1B, four fasteners are shown, one at each of the four corners of the lounge cushion body 202. More specifically, one or more fasteners 250 may be located adjacent to each of the corners of the lounge cushion body 202. In this way, the fasteners 250 may be used to tie the corners of the lounge cushion body 202 to corresponding portions of a lounge chair, allowing the lounge cushion 200 to be fixed in position relative to the lounge chair.

Figure 3:
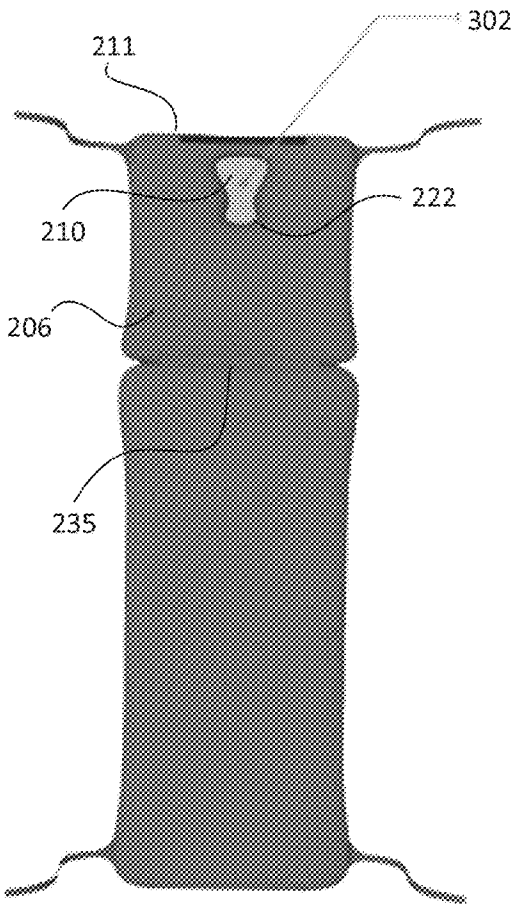
FIG. 3 shows a bottom view of the example lounge cushion of FIG. 2.

Reference is now made to FIG. 3, which shows a bottom view of the lounge cushion 200 of FIG. 2. In at least some embodiments, the second aperture 222 has a shape that corresponds to the shape of the first aperture 220. That is, the shape of the second aperture 222 may be the same as the shape of the first aperture 220. In particular, the second aperture 222 may have a wider first end and a narrower second end opposite to the first end. The lounge cushion 200 includes a permeable screen 302. The permeable screen 302 is, at least, gas permeable. The permeable screen 302 is disposed in the cavity 210 between the first aperture 220 and the second aperture 222. The permeable screen 302 may be integral with the lounge cushion 200 or removably coupled to the cushion body 202. In some embodiments, the permeable screen 302 is interposed between the first aperture 220 and the second aperture 222. In particular, the permeable screen 302 is positioned inside the cavity 210 and located partially between the first aperture 220 and the second aperture 222. The permeable screen 302 is generally parallel to the top and bottom surfaces 204 and 206. The permeable screen 302 may cover the entirety or only part of the cross-sectional area of the cavity 210. When a user lies in a prone position on the top surface 204 of the cushion body 202, at least part of the user's face is received in the cavity 210. The permeability of the screen 302 allows for the flow of air into and out of the cavity 210 through the second aperture 222 such that the user may breathe comfortably when in the prone position on the top surface 204. For example, the permeable screen 302 may include a plurality of holes defined thereon.

In some other embodiments, the permeable screen 302 may be positioned outside of the cavity 210. For example, the permeable screen 302 may be disposed on the bottom surface 206 to cover at least a portion of the second aperture 222. The permeable screen 302 may be positioned on a fabric cover which covers the bottom surface of a pad of the cushion body 202. For example, the permeable screen 302 may be positioned on a portion of a fabric cover which covers the bottom surface of the upper cushion portion of the cushion body 202. The permeable screen 302 may, for example, be removably attached to the fabric cover or it may be integral with the fabric cover. The permeable screen 302 may be positioned such that it covers at least a portion of the second aperture 222. For example, in some embodiments, the permeable screen 302 may be sized to completely cover the second aperture 222. In particular, the permeable screen 302 may have greater dimensions than the second aperture 222.

The permeable screen 302 may be constructed from an elastic fabric or any other type of fabric (such as polyester). In some embodiments, the permeable screen 302 may be a mesh which is removably attached to a fabric that covers the bottom surface 206. For example, the permeable screen 302 may be attached to a fabric covering the bottom surface 206 on both sides of the second aperture 222. A permeable screen 302 in the form of a mesh may provide structural support for the fabric cover which covers the pad of the cushion body 202, for example, as a result of the tension created in the mesh.

Figure 4:
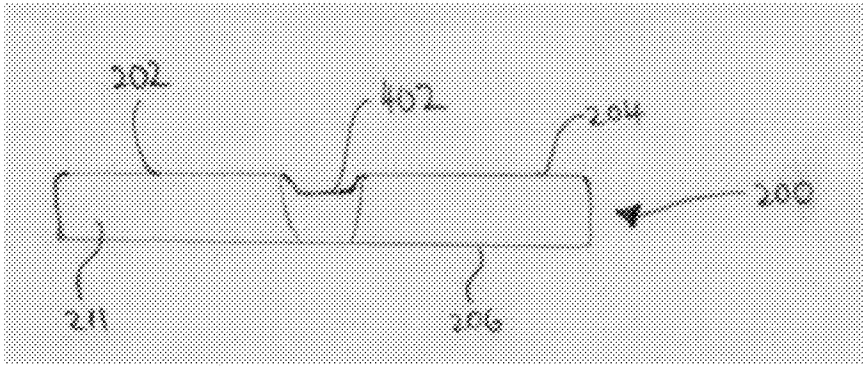
FIG. 4 shows a side elevational view of the example lounge cushion of FIG. 2.

Reference is now made to FIG. 4, which shows a side elevational view of the lounge cushion 200 of FIG. 2. FIG. 4 corresponds to a side view of the top edge of the cushion body 202, or the edge of the cushion body 202 which is proximal to a user's head when the user lies on the cushion body 202. FIG. 4 shows a chin support surface 402. The lounge cushion 200 may include a chin support surface 402 which is adjacent to the top end 211 of the cushion body 202. In at least some embodiments, the chin support surface 402 comprises a recess in the top surface 204. For example, as can be seen in FIG. 4, the chin support surface 402 may be a depression which extends partially between the top surface 204 and the bottom surface 206. That is, the chin support surface 402 may be a recess which extends only partially into the cushion body 202. In some embodiments, the chin support surface 402 may comprise a portion of the top surface 204. For example, the cavity 210 may be in spaced relation to the top end 211 and the chin support surface 402 may be a portion of the top surface 204 which extends between the top end 211 and the cavity 210. In some embodiments, the chin support surface 402 may be a raised surface adjacent to the cavity 210. In particular, the chin support surface 402 may be a surface which is raised and/or angled with respect to the top surface 204 and located adjacent to the cavity 210. In some other embodiments, the chin support surface 402 may be substantially flush with the top surface 204. The chin support surface 402 may provide a platform on which a user may rest her chin when lying in a prone position on the top surface 204. For example, if a user desires to read a book or, more generally, glance in a forward direction while lying in a prone position, the user may rest her chin against the chin support surface 402. In some embodiments, the chin support surface 402 may extend from a first end wall of the cavity 210 (not shown in FIG. 4) towards the top end 211 of the cushion body 202. That is, the chin support surface 402 may be structurally connected to the cavity 210. This configuration of the chin support surface 402 may allow a user to transition smoothly from lying prone with her head partially inserted in the cavity 210 to raising her head to rest her chin against the chin support surface 402. In some cases, the chin support surface 402 may serve to limit the length of the cavity 210. In particular, the chin support surface 402 may prevent a user's face from being inserted entirely into the cavity 210, by supporting at least a portion of the user's head when the user is lying in a prone position on the lounge cushion 200. That is, the chin support surface 402 may alternatively serve as a support surface for a user's forehead when the user is in a face-down position. The chin support surface 402 may be integral with the cushion body 202 or it may be a separate component which can be secured to the cushion body 202 by one or more attachment means. For example, the cushion body 202 may be designed to receive a chin support surface 402 as an add-on component which can be removably attached to the cushion body 202.

Figure 5:
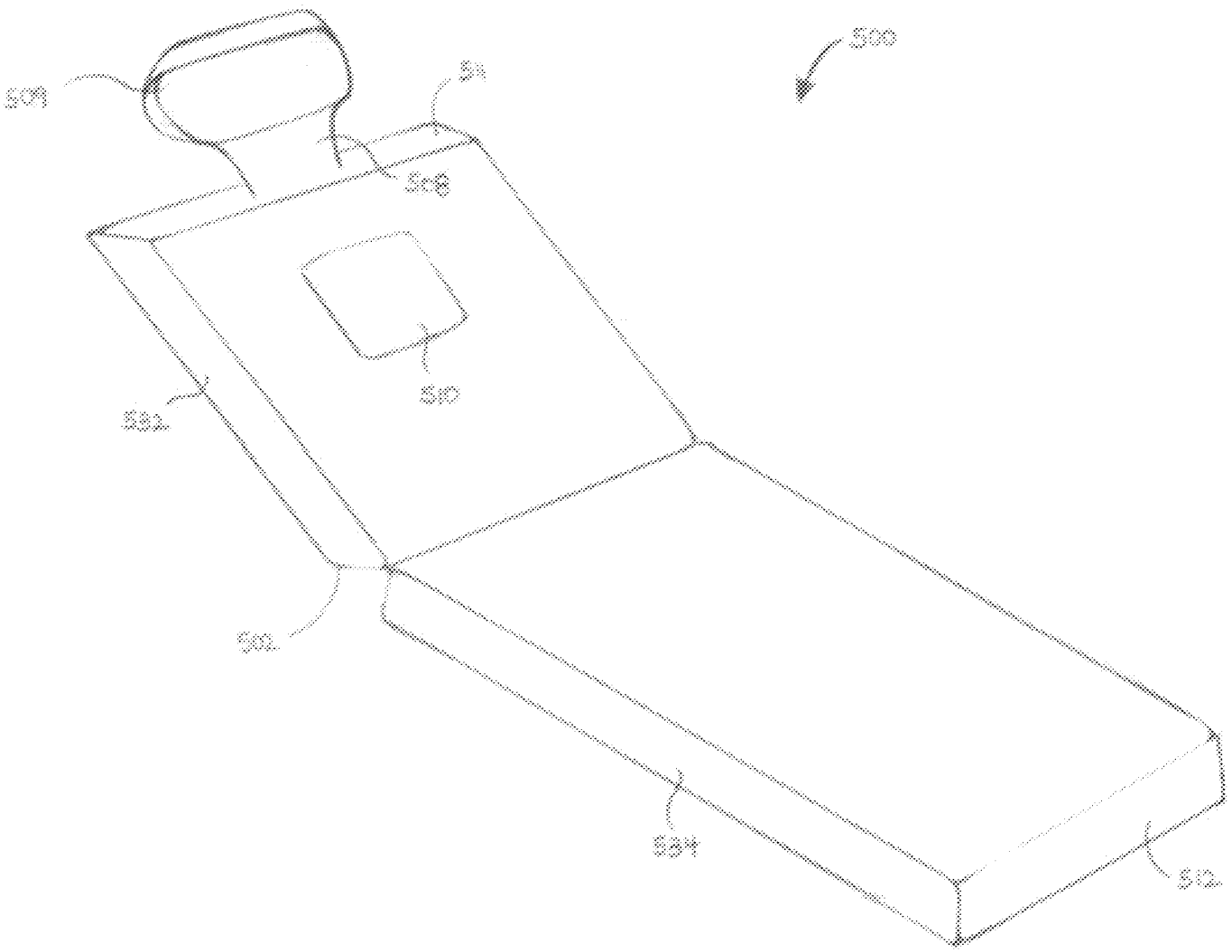
FIG. 5 shows a perspective view of another example lounge cushion in accordance with example embodiments of the present disclosure.

Reference is now made to FIG. 5, which shows a perspective view of another example lounge cushion 500. The lounge cushion 500 includes an elongate cushion body 502, which comprises an upper cushion portion 532 and a lower cushion portion 534. The upper cushion portion 532 has a top surface and an opposed bottom surface. The upper cushion portion 532 defines a cavity 510, which is similar to the cavity 210 of FIG. 1B. In particular, the cavity 510 may extend between a first aperture on the top surface of the upper cushion portion 532 and a second aperture on the bottom surface of the upper cushion portion 532. As shown in FIG. 5, the lounge cushion 500 includes a pillow 509. In at least some embodiments, the pillow 509 is movably attached to the cushion body 502. In particular, the pillow 509 may be attached to the top end 511 of the cushion body 202. For example, the pillow 509 may be secured to the top end 511 of the cushion body 502 via an attachment member 508. The attachment member 508 may be movable between different positions, for example, by folding, swinging or pivoting/folding. In some embodiments, the pillow 509 may be moved to different positions relative to the cushion body 502 by folding (or swing, pivoting/folding, etc.) and unfolding the attachment member 508. For example, the attachment member 508 may be folded to move the pillow 509 to a position in which the pillow 509 covers, at least partially, the cavity 510. The pillow 509 may, for example, have a width that is greater than the width of the cavity 510 such that the pillow 509 is supported by the top surface of the upper cushion portion 532 on both sides of the cavity 510. This configuration of using a pillow 509 to cover at least a portion of the cavity 510 may be useful in supporting the head and/or the neck of a user when the user is lying on her back on the lounge cushion 500. Starting from this position of the pillow 509 partially covering the cavity 510, the attachment member 509 may be unfolded to remove the pillow 509 from over the cavity 510. For example, the pillow 509 may be moved to a position in which the pillow 509 does not lie on the top surface of the upper cushion portion 532.

The pillow 509 may support a user's head and/or neck either when the pillow 509 is positioned to cover at least a portion of the cavity 510 or when the pillow 509 is moved off of the top surface of the upper cushion portion 532. For example, in some embodiments, the attachment member 508 may be folded/pivoted to an extended position in which the attachment member 508 extends from the top end 511 away from the cushion body 502. In such a position, the attachment member 508 may be configured to maintain the pillow 509 in spaced relation from the top end 511 of the cushion body 502, and the combination of the attachment member 508 and the pillow 509 may support at least a portion of a user's head and/or neck when the user is lying on her back on the lounge cushion 500. The attachment member 508 may, for example, be sufficiently rigid to support the pillow 509 in a fixed relative position away from the cushion body 502. In some embodiments, the length of the attachment member 508 may be adjustable. For example, the length of the attachment member 508 may be increased or decreased to accommodate a user's height. That is, the length of the attachment member 508 in the extended position may be adjusted such that the pillow 509 and the attachment member 508 can support the user's head and neck when the user lies on her back on the lounge cushion 500.

In at least some embodiments, the attachment member 508 may be of such length as to enable the pillow 509 to be moved to cover, at least partially, the cavity on the bottom surface of the upper cushion portion 532. For example, the pillow 509 may be configured to move (e.g. by swinging, pivoting/folding, etc. the attachment member 508) between being supported on the top surface of the upper cushion portion 532 and being supported on the bottom surface of the upper cushion portion 532. In some embodiments, the pillow 509 may be moved to cover, at least partially, the cavity 510 either from the top surface or the bottom surface of the upper cushion portion 532. For example, the pillow 509 may support a user's face when the user is lying in a prone position on the top surface of the upper cushion portion 532, by covering the cavity 510 from the top surface, or support a user's head and/or neck when the user is lying on her back on the bottom surface of the upper cushion portion 532, by covering the cavity 510 from the bottom surface.

In some embodiments, the pillow 509 may be attached to the cushion body 502 by other means. For example, the pillow 509 may be slidably mounted on the top surface of the upper cushion portion 532 such that it may be moved (by sliding) to cover, at least partially, the cavity 510. The pillow 509 may be secured to the cushion body 502 and located, for example, on the top surface of the upper cushion portion 532 between the top end 511 and the cavity 510 such that it may be slid towards the opening of the cavity 510 when it is desired to cover the cavity 510. In at least some embodiments, the attachment member 508 may comprise Velcro™ fasteners, zippers, or other means which allow for detachment from the cushion body 502. In particular, the pillow 509 may be removably attached to the cushion body 502.

The various embodiments presented above are merely examples and are in no way meant to limit the scope of this application. Variations of the innovations described herein will be apparent to persons of ordinary skill in the art, such variations being within the intended scope of the present application. In particular, features from one or more of the above-described example embodiments may be selected to create alternative example embodiments including a sub-combination of features which may not be explicitly described above. In addition, features from one or more of the above-described example embodiments may be selected and combined to create alternative example embodiments including a combination of features which may not be explicitly described above. Features suitable for such combinations and sub-combinations would be readily apparent to persons skilled in the art upon review of the present application as a whole. The subject matter described herein and in the recited claims intends to cover and embrace all suitable changes in technology.

The invention claimed is:

1. A reversible lounge cushion, comprising:

an elongate cushion body having an upper cushion portion and a lower cushion portion foldably connected to the upper cushion portion, the upper cushion portion having a top surface and a bottom surface opposed to the top surface, the cushion body having at least one of its surfaces covered by a fabric cover and defining a cavity adjacent to a top end of the cushion body, wherein the cavity extends between a first aperture on the top surface and a second aperture on the bottom surface, and a permeable screen positioned outside the cavity for covering the second aperture, the permeable screen having greater dimensions than the second aperture and being sized to completely cover a cross-sectional area of the cavity, wherein the permeable screen is integral with the fabric cover.

2. The reversible lounge cushion of claim 1, wherein the cavity is in spaced relation to the top end of the cushion body.

3. The reversible lounge cushion of claim 1, wherein the cavity is centrally disposed between opposed lateral edges of the cushion body.

4. The reversible lounge cushion of claim 1, wherein the cavity is in the form of a channel extending along a central axis of the cushion body, the central axis extending longitudinally between the top end and an opposed bottom end of the cushion body.

5. The reversible lounge cushion of claim 4, wherein a first end of the first aperture is wider than a second opposite end of the first aperture.

6. The reversible lounge cushion of claim 5, wherein a width of the first end of the first aperture is greater than 4 inches.

7. The reversible lounge cushion of claim 5, wherein a distance between the first end and the second end of the first aperture is greater than 6 inches.

8. The reversible lounge cushion of claim 1, wherein the cushion body has a thickness of at least 3 inches.

9. The reversible lounge cushion of claim 1, wherein the permeable screen comprises an elastic fabric.

10. The reversible lounge cushion of claim 9, wherein the fabric comprises a mesh.

11. The reversible lounge cushion of claim 1, wherein the bottom surface is covered by the fabric cover and wherein the permeable screen is attached to the fabric cover on both sides of the second aperture.

12. The reversible lounge cushion of claim 1, further comprising a chin support surface adjacent to the top end of the cushion body.

13. The reversible lounge cushion of claim 12, wherein the chin support surface comprises a recess in the top surface.

14. The reversible lounge cushion of claim 1, further comprising a pillow secured to the top end of the cushion body, wherein the pillow is movable between a first position in which the pillow at least partially covers the cavity and a second position in which the pillow does not cover the cavity.

15. The reversible lounge cushion of claim 14, wherein the pillow is foldably secured to the top end of the cushion body.

16. A chair assembly, comprising:

a chair frame; and a reversible cushion removably mounted on the chair frame, the cushion including:

an elongate cushion body having an upper cushion portion and a lower cushion portion foldably connected to the upper cushion portion, the upper cushion portion having a top surface and a bottom surface opposed to the top surface, the cushion body having at least one of its surfaces covered by a fabric cover and defining a cavity adjacent to a top end of the cushion body, wherein the cavity extends between a first aperture on the top surface and a second aperture on the bottom surface, and a permeable screen positioned outside the cavity for covering the second aperture, the permeable screen having greater dimensions than the second aperture and being sized to completely cover a cross-sectional area of the cavity, wherein the permeable screen is integral with the fabric cover.

* * * * *